US005292093A

United States Patent [19]

Shumake

[11] Patent Number: 5,292,093

[45] Date of Patent: Mar. 8, 1994

[54] PROTECTIVE INSERT FOR A PLASTIC TRASH BAG

[76] Inventor: Ernest L. Shumake, 5404 Waterview Dr., Arlington, Tex. 76016

[21] Appl. No.: 274,426

[22] Filed: Nov. 21, 1988

Related U.S. Application Data

[63] Continuation-in-part of Ser. No. 163,614, Mar. 3, 1988, abandoned.

[51] Int. Cl.[5] ..... B65D 5/00

[52] U.S. Cl. ..... 248/97; 248/152

[58] Field of Search ..... 248/97, 99, 101, 95, 248/152, 150; 294/1.1; 383/34.1, 104, 12; 220/1 T, 403, 62, 85 H, 737

[56] References Cited

U.S. PATENT DOCUMENTS

| | | | |
|---|---|---|---|
| 3,438,562 | 4/1969 | Conner et al. | 220/403 |
| 3,817,444 | 6/1974 | Yoch | 220/403 X |
| 4,064,969 | 12/1977 | Black | 248/99 X |
| 4,115,909 | 9/1978 | Corella | 383/104 X |
| 4,281,813 | 8/1981 | Garrity | 248/97 |
| 4,299,365 | 11/1981 | Battle | 248/99 |
| 4,338,979 | 7/1982 | Dow | 248/101 X |
| 4,530,533 | 7/1985 | Dieter | 248/99 X |
| 4,628,007 | 12/1986 | Ledsham | 220/1 T X |
| 4,760,982 | 8/1988 | Cooke | 248/99 |
| 4,814,039 | 3/1989 | Willging | 156/328 |

*Primary Examiner*—Karen J. Chotkowski

[57] ABSTRACT

A foldable holder for flexible trash bags, the holder having planar sections which are connected to one another along adjacent edges so as to form a closed or tubular body. The preferred material for the planar sections or panels is corrugated paperboard (i.e., "cardboard"). The preferred configuration includes four connected panels which are sized to create a square-shaped holder when the panels are moved to their fully expanded condition. Two opposite panels are scored vertically along their mid-regions so that they may be folded internally until they touch—or nearly touch, thereby allowing the other two sides to be brought together in a parallel fashion. The collapsed mode for the holder (wherein the holder constitutes only about 5% of its expanded mode) constitutes a handy storage condition for the holder, so that it might be tucked behind an appliance such as a stove or hung in a closet when it is not in use. The sizes of the respective panels are designed so that the circumference of the expanded holder will be as large as the nominal circumference of the bag that is to be supported, but not more than about 2% greater than the nominal circumference of the bag, whereby a very slight stretching action may be required in order to install the holder inside a bag. A slightly stretched plastic bag will tend to hold the expanded holder in its full-open condition, such that no auxiliary clips, braces or frames are needed in order to maintain a holder open. The holder is self-supporting, so that it may be loaded in either its vertical or horizontal mode. When the bag is full, the top of the holder is grabbed and manually lifted out of the bag.

5 Claims, 1 Drawing Sheet

PROTECTIVE INSERT FOR A PLASTIC TRASH BAG

REFERENCE TO RELATED APPLICATION

This application constitutes a continuation-in-part of application Ser. No. 07/163,614 filed Mar. 3, 1988, now abandoned.

BACKGROUND OF THE INVENTION

This invention relates generally to rigid supports and holders for flexible plastic bags of the kind that are not self-supporting and which are commonly used to receive and transport residential trash, leaves, brush and related matter that is to be discarded; more specifically, it relates to a device for preventing any discarded matter that has sharp corners or sharp points (such as rose brush clippings) from accidentally tearing the sides of such a plastic bag during the process of loading the discarded matter in the bag.

It is known that large flexible bags, typically made of thin polyethylene, are especially handy for disposing of trash and waste matter which is to be discarded, especially including refuse from a yard—such as leaves, weeds, branches and thorns, grass clippings, etc. These bags are usually relatively large, often rated at 39 to 55 gallons; and many such bags are specifically sold for the purpose of accommodating lawn and yard refuse. These relatively large bags are often called "lawn and leaf" bags, although they probably differ from other plastic bags only in their total capacity and perhaps their wall thickness.

In addition to "lawn and leaf" or similar bags intended for outdoor use, it is common to use polyethylene bags having a capacity of about 26 to 33 gallons for handling household trash and garbage that tends to regularly materialize inside a residence, including discarded packing material, waste paper, junk mail, empty bottles and food scraps, etc. Such indoor-type or "garbage" bags are more commonly used within a house, of course, and they are less frequently exposed to the kind of sharp material which would be expected to cut or tear a bag. That is, if a household trash bag fails, it normally does so because its capacity was exceeded, i.e., too many heavy things were put into the bag, and the excess weight caused a seam or wall to part. But because there is no way to anticipate whether a consumer will use a 26-gallon plastic bag inside the house or in the yard, all such bags having a size that is large enough to make them practical for outdoor use will be considered to fall within the scope of this invention. For convenience, then, all plastic bags having a rated capacity of at least 26 gallons will be referred to herein as simply trash bags.

It is known to use auxiliary holders for trash bags in order to support them during the time that trash is being accumulated therein. One such holder is disclosed in U.S. Pat. No. 4,037,778 to Boyle entitled "Universal Bag Support." Apart from the technical advantages or disadvantages of the Boyle structure, his disclosure makes a very good point when it suggests that plastic bag holders may advantageously be divided into two principal groups: those which support a bag from the outside and those which support it from the inside. The Boyle disclosure is also believed to be accurate when it describes many of the disadvantages of holders that are of the "outside" support category; naturally, Boyle recommends and teaches a holder of the "inside-the-bag" type.

There are believed to be many inherent disadvantages of outside supports, including complexity, cost, the possibility of losing clamps or loose parts, etc. However, one such outside support has at least been proposed that would reduce at least one of the problems of the prior art—in that it reduces the number of parts to only two. This two-piece holder comprises a special elastic member (like a giant rubber band) that cooperates with a specially configured cardboard support; this holder is disclosed in U.S. Pat. No. 4,338,979 to Dow entitled "Bag Holding Device and Process." However, as with all such constructions, a trash bag in a Dow holder is vulnerable because it is inside the holder—where it comes into contact with all kinds of things that can tear the wall of a bag. That is, the sharp edge of a can or the thorns of a rose bush could easily puncture and then proceed to introduce a longitudinal tear in an unprotected bag that is resting inside the holder. Persons who have had experience with thorns starting at the top of a bag and ripping their way all the way down to the bottom of a polyethylene bag will clearly appreciate the deficiency of supporting a bag upright but leaving its sides exposed to tearing elements. The typical result of using such a holder to collect thorny refuse is that grabbing the top of the plastic bag and lifting it out of the holder causes the immediate dumping of all the accumulated trash onto the ground adjacent the holder.

The aforementioned Boyle holder, on the other hand, is an inside-the-bag support, and it does seem like it might solve at least a few of the problems associated with outside supports. However, it is believed that even a Boyle holder is not perfect, in that the effort to make it a truly "universal" holder for all kinds and sizes of trash bags has required such compromises as to render the holder less efficient in some ways than it could be. For one thing, the desire to fabricate a Boyle holder out of economical cardboard and yet make it expandable in girth has required that the side panels be arranged as a serial array of panels that are not connected along one "edge." The result is what may be referred to as a "wrap-around" holder that includes one very long piece of cardboard having a length that ideally exceeds the maximum anticipated circumference of the bags that are to be held. (In this regard, it should be known that even a conventional 33-gallon trash bag has a circumference of about five feet, and some 55-gallon bags have a circumference of nearly eight feet.) Of course, if the circumference of the bag is not exceeded, so that there is no overlap of the two ends of the wrapped holder, than at least part of the plastic bag will remain unprotected by virtue of the gap in the cardboard "wall" when the holder is installed. And to paraphrase an old saying about the strength of a chain, a holder that is intended to provide tear protection for the walls of trash bags is only as good as the weakest part of the holder/bag combination. Expressed in other words, if any part of a vulnerable trash bag is left unprotected, then the entire bag is subject to becoming sufficiently damaged that the entire bag can fail. Another way of evaluating a trash bag holder is based upon the recognition that trash bags (somewhat like eggshells) do not generally fail in part; a bag is either totally successful in keeping its trash contained—or it is usually considered to be a failure by its user. That is, no one takes any real satisfaction that only half of a trash bag's contents have spilled onto a freshly swept side-walk or driveway—when one side of a bag rips. In the real world of trash removal, then, there is no room for partial success of trash bags.

Another deficiency of a wrap-around holder like that shown by Boyle is that it can be efficiently used only in the mode in which it is shown in the figures of the Boyle patent—namely, upright. That is, if a Boyle holder is truly collapsable (for compact storage) as he claims, then there is no guaranteed way of keeping the holder—and hence a bag—open when it is lying on its side. Those persons who like to first accumulate leaves in a pile and then sweep them into a horizontally oriented bag would likely need the aid of an assistant in order to grasp and hold a Boyle device in an open condition in order for it to receive leaves. Turning what could be a one-man yard job into a two-man job is not what most people would consider to be progress, unless one's goal is perhaps to try to cure the world's unemployment problem.

It follows, therefore, that there remained a need for a satisfactory way of efficiently supporting flexible bags in at least a temporary fashion so that they can be filled with refuse, while at the same time protecting all of the side walls of the bag from being ripped by a sharp edge. It is an object of this invention to provide such a holder and do so in an economic manner.

Another object is to provide a holder for flexible bags which can be stowed in a relatively flat condition so that it occupies a minimum amount of space, while at the same time providing a stable construction for holding a bag in such a way as to encompass the maximum volume of space permitted by the geometry of the bag.

A further object is to provide a holder that is stable and not subject to collapse when in either a horizontal and a vertical mode, so that leaves or other refuse can be accumulated in a trash bag by a single person using either the "vertical dump" or the "horizontal sweep" method of trash loading.

These and other objects will be apparent from a reading of the specification and the claims appended thereto, as well as reference to the several figures of the drawings provided herewith.

BRIEF DESCRIPTION OF THE INVENTION

In brief, this invention relates to a foldable holder having planar sections, said sections being connected to one another along adjacent edges so as to form a closed or tubular body. The preferred material for the planar sections or panels is corrugated paperboard—which is commonly referred to by many people as cardboard. Another suitable material is a rigid foamed plastic having closed cells on its exposed surfaces or at least a completely smooth sheet of thin material attached to said exposed surfaces in such a way as to be integral therewith. The preferred configuration includes four connected panels which are sized to create a square-shaped holder when the panels are moved to their fully expanded condition. Two opposite panels are scored vertically along their mid-regions so that they may be folded internally until they touch—or nearly touch, thereby allowing the other two sides to be brought together in a parallel fashion. The collapsed mode for the holder (wherein two sides are folded inwardly and two sides are brought very close together) constitutes a very handy storage condition for the holder, so that it might be tucked behind an appliance such as a stove or hung in a closet when it is not in use, thereby consuming a minimum amount of useful space. The sizes of the respective panels are designed so that the circumference of the expanded holder will be as large as the nominal circumference of the bag that is to be supported, but not more than about 2% greater than the nominal circumference of the bag, whereby a very slight stretching action may be required in order to insert the holder inside a bag. A slightly stretched plastic bas will tend to hold the expanded holder in its full-open condition, such that no auxiliary clips, braces or frames are needed in order to maintain a holder open. The length of the holder, as measured in a vertical direction when the bag is held in its upright and open condition, will be sized to extend from the bottom of an open bag to a few inches from the top of the bag, so that it would be possible to fold the top of the bag over the holder while it is being filled.

DETAILED DESCRIPTION OF A PREFERRED EMBODIMENT OF THE INVENTION

Figure 1:
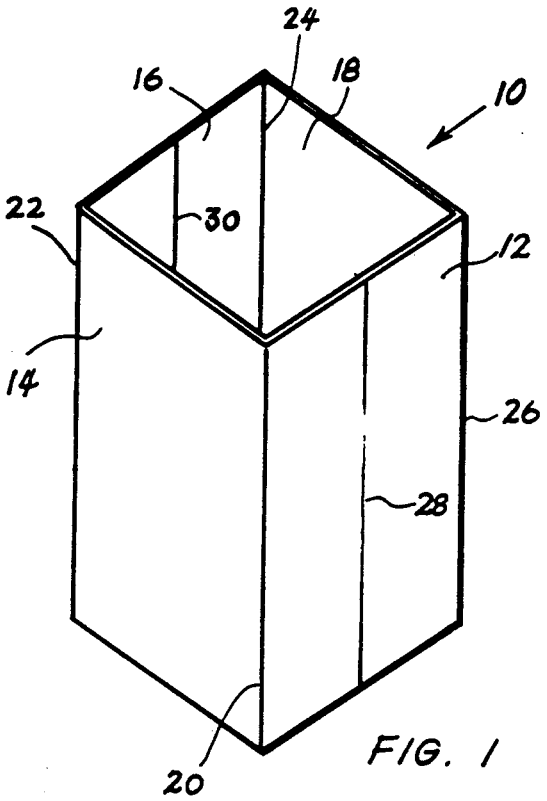
FIG. 1 is a perspective view of a holder in accordance with this invention, and shows it in its fully open (i.e., expanded) mode, as it would normally rest in order to support a trash bag in an upright position for accepting trash.

Referring initially to FIG. 1, a holder 10 in accordance with this invention includes a set of serially connected structural panels that are joined together along certain of their edges in such a way as to form what may be called an elongated tube. In the embodiment illustrated in FIG. 1, there are four such structural panels, which are identified by the reference numerals 12, 14, 16, 18. The joint between panels 12 and 14 will be identified by the reference numeral 20; the joint between panels 14 and 16 will be identified by the reference numeral 22; the joint between panels 16 and 18 will be identified by the reference numeral 24; and the joint between panels 18 and 12 will be identified by the reference numeral 26. The joints 20, 22, 24, 26 are coextensive with what will be understood to be the length of the "tube," and this length dimension will normally be oriented vertically when the tube is positioned to support a trash bag in an upright condition. Two of the panels (i.e., panels 12, 16) have centrally positioned and longitudinal creases or score lines 28, 30 which give the respective panels a slight pre-disposition toward bending inwardly when the holder 10 is standing upright. But these score lines 28, 30 do not rigidly restrict the panels 12, 16 to folding inwardly; under certain circumstances these panels can take on a slightly outward cant, such that the holder will appear to be bulged outward along two opposite sides. By virtue of the score lines 28, 30, the holder is switchable at will between its expanded mode (FIG. 1) and a collapsed mode—without disconnecting any of the panels.

Figure 3:
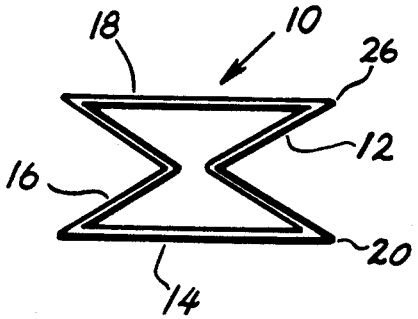
FIG. 3 is an end view of the holder, looking longitudinally thereof, and showing the holder partially collapsed.
Figure 4:
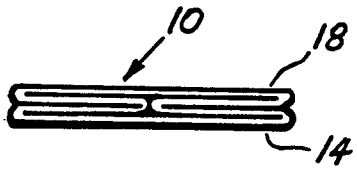
FIG. 4 is an end view of the holder showing it fully collapsed, as it would be rendered for storage.

FIG. 3 shows the holder 10 partially collapsed, and FIG. 4 is a top or end view of the holder when fully collapsed. From an examination of FIG. 4, it will be apparent that panels 14, 18 have been brought together so that they are both parallel and very close to one another. The central portions of panels 12, 16 are also brought very close together, such that they touch or almost touch one another, but they do not press against one another with sufficient force as to introduce any compression loads in the members. For convenience and simplicity, the two panels 14, 18 that always remain parallel will generally be referred to as side panels, and the two creased panels 12, 16 will be referred to as end panels.

Figure 2:
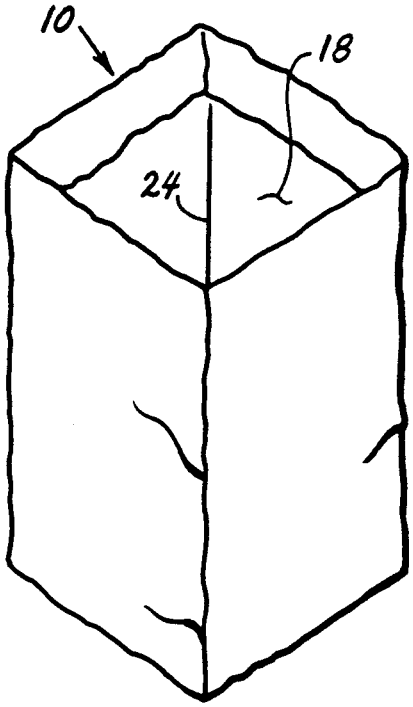
FIG. 2 is a perspective view of the combination of a holder as shown in FIG. 1 and a flexible trash bag being supported thereby.

The length of the holder 10 is slightly less than the height of a trash bag for which the holder has been designed. Preferably, there is an excess bag length of about three to five inches, so that the top of a flexible bag may, if desired, be folded inwardly and over the top of the holder 10 (as shown in FIG. 2). Also, by deliberately making the holder 10 somewhat shorter than the bag length, there is a kind of built-in gauge or reminder to users that they should fill the bag no higher than the top of the holder, in order to leave at least some free length of bag material that can be gathered for the purpose of effecting some kind of tied condition. For example, a parent can instruct a child to fill a bag with leaves but to not fill it over the top of the holder, so that there will more likely be enough residual bag for installing a wire or plastic tie to hold a full bag closed.

Most 26-gallon bags will have a height of about 36 inches, so a holder specifically designed for such bags would be expected to have a height of perhaps 30 inches. Most 33-gallon bags have a height of about 38 inches, so a holder 10 for such bags would be expected to have a height of about 35 inches. Bags for holding up to 55 gallons of refuse will usually vary in height from about 50 to 58 inches, and a holder about 50 inches tall (when the holder is oriented vertically) will usually be desired. In this regard perhaps it should be mentioned that experimentation has revealed that a flexible polyethylene bag will usually remain pretty much in place around an "inside" holder 10 made of cardboard—if the circumference of the holder is within about 2% of the circumference of the bag to be held. That is, a 1.3 mil plastic bag will not usually slide down (or collapse to the ground) from its vertical position, even if the bag is larger than the holder, as long as the bag excess is within about 2% of the girth of the holder. And if the girth of the holder 10 is not more than 2% greater than the circumference of a polyethylene trash bag (at rest), it has been found that there is enough resilience in the material of commercially available trash bags so that they can be stretched to go around a fully opened holder. Indeed, to have the girth of an expanded holder 10 just slightly larger than the circumference of a bag will tend to add even more stability to the combination of a bag and holder, especially when the two end panels 12, 16 are caused to bow slightly outward—to what may be called an "over center" condition.

A noteworthy characteristic of the holder 10 will be apparent when it is being used to receive leaves. It is characteristic of dry leaves that they tend to be crisp and non-planar; like a pile of potato chips, a loose pile of dry leaves will usually be "fluffy" and voluminous. Hence, dry leaves can frequently be compressed—by stepping on them—so that they can be made to occupy a space that is very much smaller than the space they occupy in their natural state. Therefore, many people will fill a trash bag about half full of leaves, and then swing one leg up, over and into the open top of the bag for the purpose of stepping on the leaves in order to compress them, thereby making it possible to put many more light-weight leaves in a given bag. With the holder 10, any vertically directed force imposed by the weight of a person's body in stepping on leaves, and any consequential horizontal force that might tend to stretch and burst a trash bag, can be resisted by the totally connected walls of the holder 10—which have a significant tensile strength. Cardboard of the type used in large shipping boxes is the preferred material for the holder 10, and such cardboard has a rated bursting strength of 200 pounds per square inch; the actual tensile strength is usually much more than that, of course. It is perhaps worth mentioning here that the common act of leaf compression by stepping in a bag of leaves would be unwise with a wrap-around holder of the type disclosed by Boyle, because there is nothing in a wrap-around holder to resist the transverse (bursting) loads that would be imposed on a plastic bag as someone tried to compress the leaves.

A further advantage of the particular device is that it will protect the arms and hands of a person who is carrying a full bag of rose bush clippings, dry branches, thistles, stickers or other things which have sharp points and which might otherwise pierce the wall of a bag and scratch an arm or hand that is embracing the bag. Therefore, a trash bag that is filled with sharp and potentially injurious thorns or the like can be more safely transported to the trash collection site.

To foster convenience in placing trash into a holder 10, and to make withdrawal of the holder from a full bag easier, it is advantageous that the panels of the holder 10 have a smooth surface with a coefficient of friction that is relatively low. If the panels 12, 14, 16, 18 are made of corrugated paperboard (i.e., cardboard), it may be advantageous to also treat them with Michelmon, a product available from Mobile Chemical Company that tends to improve the properties of cardboard, including making it more nearly waterproof and improving its surface finish, etc. Alternatively, cardboard panels could be coated, as with a waxy material, to lower their coefficient of friction with respect to such materials as are commonly handled as refuse. If the panels are made of relatively rigid and self-supporting plastic sheets, no surface treatment will usually be required in order to realize the desirable surface qualities for panels.

Another advantage of the holder 10 (in comparison with other holders having non-connected panels) is that it is as fully self-supporting in its horizontal mode as it is in its vertical mode. In other words, when it is lying on one of its sides, the holder 10 does not need any wire braces or rigid supports to keep it open. It would therefore, be possible for someone to insert a collapsed holder 10 into a limp trash bag and then push the two sides 14, 18 apart, thereby expanding the bag to its full capacity. The bag and its holder could then be laid on the ground beside a pile of leaves, and the leaves could be swept into the open mouth of the bag without any assistance from another person. When the bag is at least partially full, the holder 10 can be turned upright and the leaves compressed in the bottom of the bag—by pushing downward on them. If a substantial fresh space has been created by the compressing step, the holder may be switched back to its horizontal orientation, or it may be left vertical. Any thorns or other sharp objects will not affect the sides of the bag during loading, because they will slide harmlessly along the hard walls of the holder 10. When the bag is as full as the user desires, the holder 10 is simply grasped at the top and lifted, leaving the bag and its contents behind.

It may be that any thorns in the refuse will at this time puncture the bag wall—because of the absence of the protective holder 10. But a mere puncture is normally not enough to cause a bag to become destructively torn, as long as there are not any external forces acting on the bag. In other words, a polyethylene bag can be subjected to a great amount of tension and it will not tear, as long as there is no place (like a puncture) for a tear to start. But even a bag with puncture holes will normally not tear if it is subjected to only lifting loads, and there is no localized force applied near the puncture. It is for this reason that the holder 10 makes it possible to use ordinary polyethylene bags to accumulate what would otherwise be potentially destructive things such as rose bush trimmings.

To produce a suitably sized holder 10 for holding very common 30 gallon trash bags (using the four-panel configuration), the side panels 14, 18 will be advantageously sized as 15 by 26 inches; the end panels are sized as 15 by 26 inches, making the circumference of the opening 60 inches. The weight for such a holder (when 200 pound test cardboard is utilized) will be about 1.25 pounds. A holder for 33 gallon bags will typically have a slightly larger opening, with a circumference of 66 inches. The volume that can be encompassed by a 33-gallon holder will be about 5,850 cubic inches, and its weight will be about one pound and six ounces. When the holder 10 is collapsed (as shown in FIG. 4), it will encompass only about 293 cubic inches, which is only about 5% of its expanded volume. Trash bags rated at 55 gallons routinely have a circumference of about 78 inches, so the size of the opening for a holder for such large bags will be designed accordingly.

While only the preferred parameters have been disclosed herein, it will be apparent to those skilled in the art that variations could be adopted without departing from the spirit of the invention. For example, so called dove-tail dies are used to make the creases in the end panels, so that they will have a natural bias toward folding inward. But other crimping tools could be used to produce other creases that have their own chacteristics. Also, the preferred style of bag holder is a four-panel holder—as shown in FIG. 1, but six or more panels could also be employed, as long as the holder can be converted to an essentially flat condition for storage. That is, the holder 10 is so bulky when it is expanded that it believed to be necessary that the number of panels be chosen so that the holder can be folded to a compact size when it is not in use. But in spite of its bulk, a cardboard holder 10 as illustrated herein for holding 33-gallon trash bags will weigh only about one pound and six ounces.

What is claimed is:

1. A dual-configuration holder for plastic trash bags of the type that are not self-supporting when they are empty, said holder having an expanded mode in which it is adapted to support a trash bag with its top open in a square configuration; to that trash may be easily inserted therein, and said holder also having a collapsed mode in which it may be stored in an essentially flat and relatively compact manner, comprising:

a set of serially connected structural panels that are permanently joined together along certain of their edges in such a way as to form an elongated tube, said tube having a length dimension that is oriented vertically when the tube is normally positioned to support a trash bag in an upright condition, and the surfaces of the panels being generally smooth and the panels being joined in such a way that the tube is switchable at will between an expanded and a collapsed mode, and the length of the tube being just slightly less than the height of an open trash bag for which the holder has been designed, and the girth of an expanded tube being approximately the same as the circumference of an open trash bag, such that the collapsed tube can be easily inserted into a bag and temporarily expanded to fully support the bag in its open condition—both when the bag is oriented vertically and when it is oriented horizontally, whereby the presence of the holder inside the trash bag protects the bag from being linearly torn when a sharp object is manually inserted into the open bag—by virture of the fact that the sharp object will contact an interior surface of one of the structural panels instead of contacting the bag wherein the circumference of the opening in the trash bag that is to be supported is a value that can be ascertained by measurement, and wherein the girth of the connected panels of the holder in their expanded mode is within two percent of that ascertained value, whereby the expanded panels can fit within an open trash bag but only with a relatively tight fit, and whereby a trash bag will be inherently supported throughout its entire length by an expanded holder without the need for any auxiliary clips or hooks.

2. The holder as claimed in claim 1 wherein the structural panels are made of corrugated paperboard having a rated bursting strength of 200 pounds per square inch and coated with water resistant additive.

3. The holder has claimed in claim 1 wherein there are four structural panels making up the set of serially connected panels, and two of the four panels are configured so as to remain planar at all times while the other two panels are scored so that they readily bend near their mid-points about parallel axes that extend longitudinally of the tube, and the holder being readily converted between its expanded and its collapsed modes by selectively bending those two panels which are configured to foster easy bending.

4. The holder as claimed in claim 1 wherein the structural panels are sized so as to fit snugly inside a trash bag having a nominal size of 33 gallons, and wherein the weight of the holder is approximately one pound and six ounces in said corrugated paperboard format.

5. The holder as claimed in claim 1 wherein the structural panels encompass a space of approximately 5,850 cubic inches when the holder is in its expanded mode, and wherein the holder encompasses a space of only about 293 cubic inches when the holder is in its collapsed mode, whereby the holder can be collapsed for storage purposes to only about five percent of its expanded size.

* * * * *